US005863350A

United States Patent [19]

Lekavich

[11] Patent Number: 5,863,350

[45] Date of Patent: Jan. 26, 1999

[54] METHOD AND APPARATUS FOR CLEANING ROLLER BLADE WHEEL BEARINGS

[76] Inventor: Carl Lekavich, P.O. Box 910, Lomita, Calif. 90717

[21] Appl. No.: 962,442

[22] Filed: Oct. 31, 1997

[51] Int. Cl.[6] ..... B08B 3/08

[52] U.S. Cl. ..... 134/23; 134/25.4; 134/116; 134/201; 206/205

[58] Field of Search ..... 134/14, 22.1, 23, 134/25.1, 25.4, 42, 116, 117, 135, 137, 166 R, 182, 201, 169 A; 206/205

[56] References Cited

U.S. PATENT DOCUMENTS

| | | | |
|---|---|---|---|
| 1,878,277 | 9/1932 | Hodge . | |
| 1,894,786 | 1/1933 | Pew . | |
| 2,137,660 | 11/1938 | Welke | 134/169 A |
| 2,369,498 | 2/1945 | Streuber . | |
| 2,484,149 | 10/1949 | Bousky . | |
| 2,493,291 | 1/1950 | Hirsch . | |
| 2,536,129 | 1/1951 | Heaney | 134/169 A |
| 2,549,837 | 4/1951 | Merritt . | |
| 2,603,228 | 7/1952 | Rustin | 134/108 |
| 2,634,738 | 4/1953 | Fuller et al. | 134/169 A |
| 2,652,350 | 9/1953 | Dailey | 134/169 A |
| 2,652,843 | 9/1953 | Schuchmann et al. . | |
| 2,675,013 | 4/1954 | Fuller et al. | 134/169 A |
| 2,702,092 | 2/1955 | Douglass | 134/169 A |
| 2,823,682 | 2/1958 | Coulter . | |
| 2,828,231 | 3/1958 | Henry . | |
| 2,854,012 | 9/1958 | Murdoch, Jr. . | |
| 3,027,590 | 4/1962 | Heim . | |
| 3,059,654 | 10/1962 | Weiner . | |
| 3,070,103 | 12/1962 | Pickard et al. | 134/108 |
| 3,482,584 | 12/1969 | Schipke . | |
| 4,570,794 | 2/1986 | Capitao, Jr. . | |
| 5,542,534 | 8/1996 | Dinter et al. | 206/407 |
| 5,678,582 | 10/1997 | McClure | 134/116 |

OTHER PUBLICATIONS

RACETEC Advertising Brochure, pp. 1–2.

*Primary Examiner*—Frankie L. Stinson
*Attorney, Agent, or Firm*—Richard C. Litman

[57] ABSTRACT

A bearing cleaning method and accompanying kit is provided which allows for the cleaning of roller blade wheel bearings. By following a succession of steps in cooperation with a kit comprising a modular stacking unit and container and closely sized to receive the unit, a user can quickly and easily clean a plurality of roller blade wheel bearings agitating an organic solvent partially filling the container. A plurality of roller blade wheel bearings are stacked within a modular stacking unit comprising a multitude of cylindrical spacing elements, a pair of planar end caps, with each planar end cap including two integral spacing elements, and a resilient band member. The modular stacking unit, once assembled, is placed within the interior volume of a container, along with a small quantity of organic solvent. After agitating the container by hand, the modular stacking unit is removed from the interior volume of the container and rolled, in a back and forth motion, along a flat, absorbent surface in order to dry the roller blade wheel bearings. The modular stacking unit is then disassembled permitting the individual roller blade wheel bearings to be lubricated and reinserted within a roller blade wheel.

11 Claims, 4 Drawing Sheets

METHOD AND APPARATUS FOR CLEANING ROLLER BLADE WHEEL BEARINGS

BACKGROUND OF THE INVENTION

1. FIELD OF THE INVENTION

The present invention relates to a method of cleaning roller blade wheel bearings that utilizes a cleaning solvent and a kit comprising a modular stacking unit which has the proportions and dimensions to fit firmly within the interior of a holding container.

2. DESCRIPTION OF THE RELATED ART

Roller blade skates are well known to be used by younger children and adults alike. Each roller blade skate includes multiple bearings well known to those who skate. Although bearing cleaning methods and devices are abundant and often have extreme ease of use as their primary aim, many individuals nonetheless have difficulty cleaning roller blade wheel bearings, because of age, time constraints, or lack of mechanical abilities. Therefore it would be useful to have a roller blade wheel bearing cleaning method, and accompanying apparatus, which could be easily understood and manipulated by any individual, regardless of age or skill.

Typically, roller blade wheel bearings are uniform, each having an outer cylindrical body and a concentrically disposed inner cylindrical body defining a central cylindrical aperture. The concentrically disposed bodies define a through-race circumscribing the central aperture. The through-race contains lubricated ball bearings exposed from both sides of the wheel bearing, which accumulate dirt, whether sealed by a gasket ring or not. Ordinarily when cleaning such wheel bearings, an individual must clean each wheel bearing individually, resulting in an inconvenient and time consuming process. In addition, cleaning solvents for bearings are generally offensive compounds that can cause a reaction if they come in contact with an individual's skin. Further, when attempting to clean a plurality of bearings simultaneously within one container, the bearings are often scratched or damaged through violent contact with one another. Finally, bearings that reside in contact during cleaning, one on top of the other, do not permit access by the solvent to the entire surface area of the bearings.

Apparatus for cleaning bearings including containers having caps for enclosing a plurality of bearings and a solvent fluid are known. The Racetec™ bearing holder kit adapted for cleaning roller blade wheel bearings includes a single and unitary frame having several slots within which a plurality of bearings can be inserted one on top of the other. The closed unitary structure differs dramatically from the modular and open structure of the instant invention which allows unimpeded passage of a solvent directly through a bearing race.

Devices for cleaning bearings that employ a modular stacking unit held firmly within the interior of a container or that prevent relative motion of and therefore limit damage to bearings are not known. Nor does any of the previously known art show a device which allows a user to facilely dry the roller blade wheel bearings by allowing a plurality of bearings to be rolled over an absorbent surface as a single unit while being held by the device.

None of the above references, taken either singularly or in combination, is seen to describe the instant invention as claimed. Thus a bearing cleaning device solving the aforementioned problems is desired.

SUMMARY OF THE INVENTION

The present invention relates to a method and an apparatus for easily cleaning of roller blade wheel bearings. By following a succession of steps in cooperation with a kit adapted for the cleaning of roller blade wheel bearings, a user can quickly and safely clean a plurality of roller blade wheel bearings using an organic solvent.

A modular stacking unit for insertion into a canister is provided, which unit is an assembly of components to allow spaced stacking of a series of roller blade wheel bearings. The components of the modular stacking unit include a first planar end cap, a second planar end cap, a plurality of cylindrical spacing elements and a resilient band or other means integrally adapted as part of the spacing elements for holding the assembly together. Each of the spacing elements comprise a body having opposing ends each with an annular ledge-portion, the ledge-portion dimensioned to allow a portion of the body to pass into the central aperture of the roller blade bearing and thereby form an annular seat to rest the bearing upon. Each end cap comprises a planar section for resting on a flat surface and an integral spacer disposed perpendicular to the planar section of the end cap, the spacer likewise having an annular ledge-portion.

Therefore, by using either the first planar end cap or the second planar end cap, an end cap can be positioned upright on a flat surface to build an upright assembly of bearings and spacers. A user first inserts a bearing horizontally onto the ledge-portion of the integral spacer, thereby seating the inside cylinder of the roller blade wheel bearing. A spacing element is then seated upon the opposing side of the bearing, and the process is repeated until a column of bearings and spacing elements is built.

In an alternative embodiment, the seat portion may be further adapted by means which permit a snap fit of a seat portion of a first spacing element axially into a neighboring spacing element to thereby form a serial assembly of bearings and spacing elements which permits the bearings to rotate freely on the resulting spacer column.

The end cap is provided with side by side integral spacers joined on the planar section, and thus parallel columns of equal height and equidistantly separated wheel bearings can be built. The columns are topped by the opposing end cap, and the resilient elastic band is secured about the roller blade wheel bearing assembly. Other binding elements which can be fastened around the medial section of the surface of the first planar end cap and the second planar end cap, thereby compressing the modular stacking unit and ensuring correct, maintained arrangement of the wheel bearings in relation to one another, may be used. The assembly thus permits the roller blade wheel bearing to rotate in either direction around an axis defined by the column.

Constructed with the proportions and dimensions to fit firmly within the interior volume of a companion container, the modular stacking unit, once assembled, is placed within this container for cleaning. Having a lid that allows selective accessibility to the container interior, the modular stacking unit can be enclosed within the container after a small quantity of organic, non-toxic, non-flammable and water soluble cleaning solvent is added to the container. The modular stacking unit, in cooperation with the container, restricts relative movement of the wheel bearings, thereby preventing damage of the roller blade wheel bearings during agitated cleaning. Due to the configuration of the roller blade wheel bearings within the modular stacking unit, the cleaning solvent is permitted contact with the entire surface area of the roller blade wheel bearings. Once the roller blade wheel bearings have been sufficiently cleaned, the modular stacking unit can be removed and the bearings together rolled while positioned on the spacer column, in a back and forth motion, over an absorbent material so as to immediately and thoroughly dry them. This confers an advantage heretofore unknown, namely being able to clean, remove and dry all of the bearings collectively, thereby substantially reducing the time necessary to complete reinstallation of the bearings and simplifying the process so that persons of all ages enjoying roller blading can perform effective bearing service. The process of cleaning is completed after the resilient band member has been removed, or the snap fit elements separated, from the modular stacking unit and the modular stacking unit has been disassembled.

Accordingly, it is a principal object of the invention to provide a method for increasing the ease of cleaning roller blade wheel bearings.

It is another principal object of the invention to provide an apparatus to be used in conjunction with a method for increasing the ease of cleaning roller blade wheel bearings.

It is a further object of the invention to provide an apparatus that allows vertical stacking of a plurality of roller blade wheel bearings which, when used in combination with a container, allows cleaning of roller blade wheel bearings without damage to the roller blade wheel bearings.

Still another object of the invention is to provide an apparatus that allows vertical stacking of a plurality of roller blade wheel bearings while permitting a fluid to freely flow over the entire surface area of the roller blade wheel bearings.

Still another object of the invention is to provide an apparatus that allows a column of roller blade wheel bearings to be stacked into an assembly which is rotatable about an axis parallel with the columns.

It is an object of the invention to provide improved elements and arrangements thereof in a bearing cleaning device for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
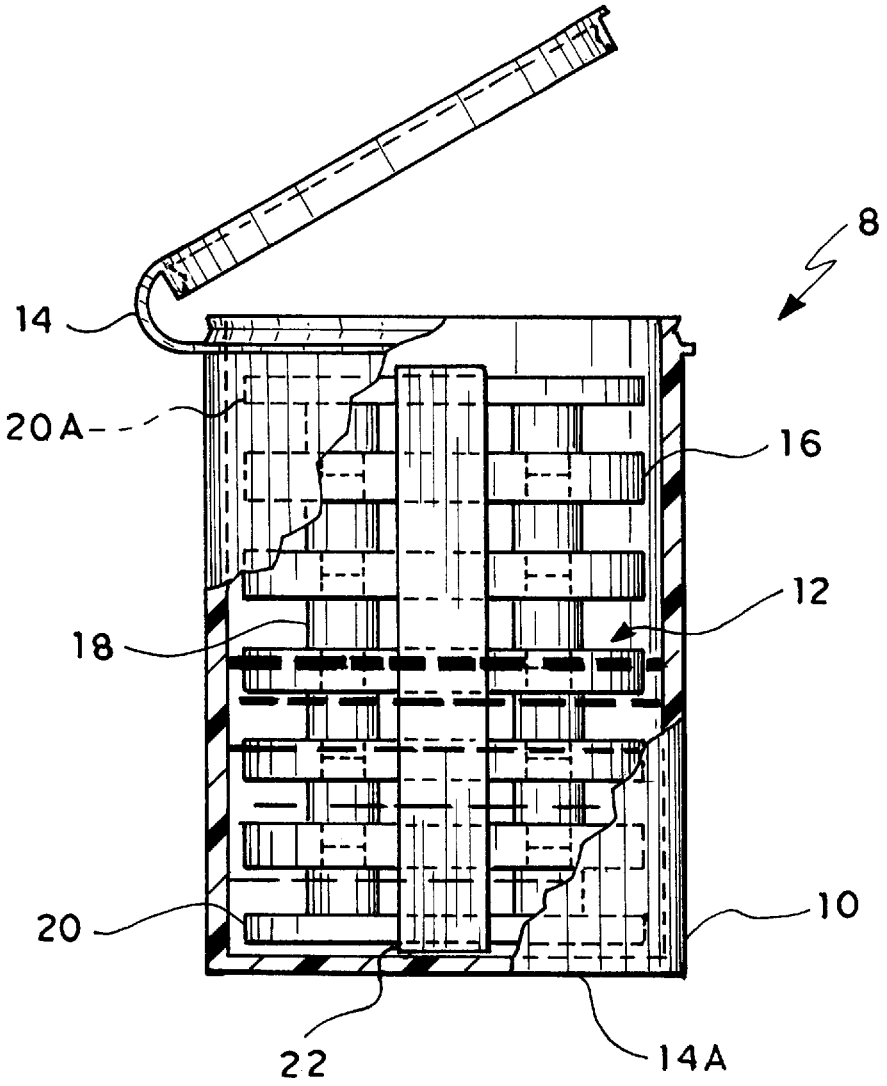
FIG. 1 is an environmental, cut-away, perspective view of a bearing cleaning kit showing a modular stacking unit in a fully assembled state within a container having a small quantity of a cleaning solvent.
Figure 2:
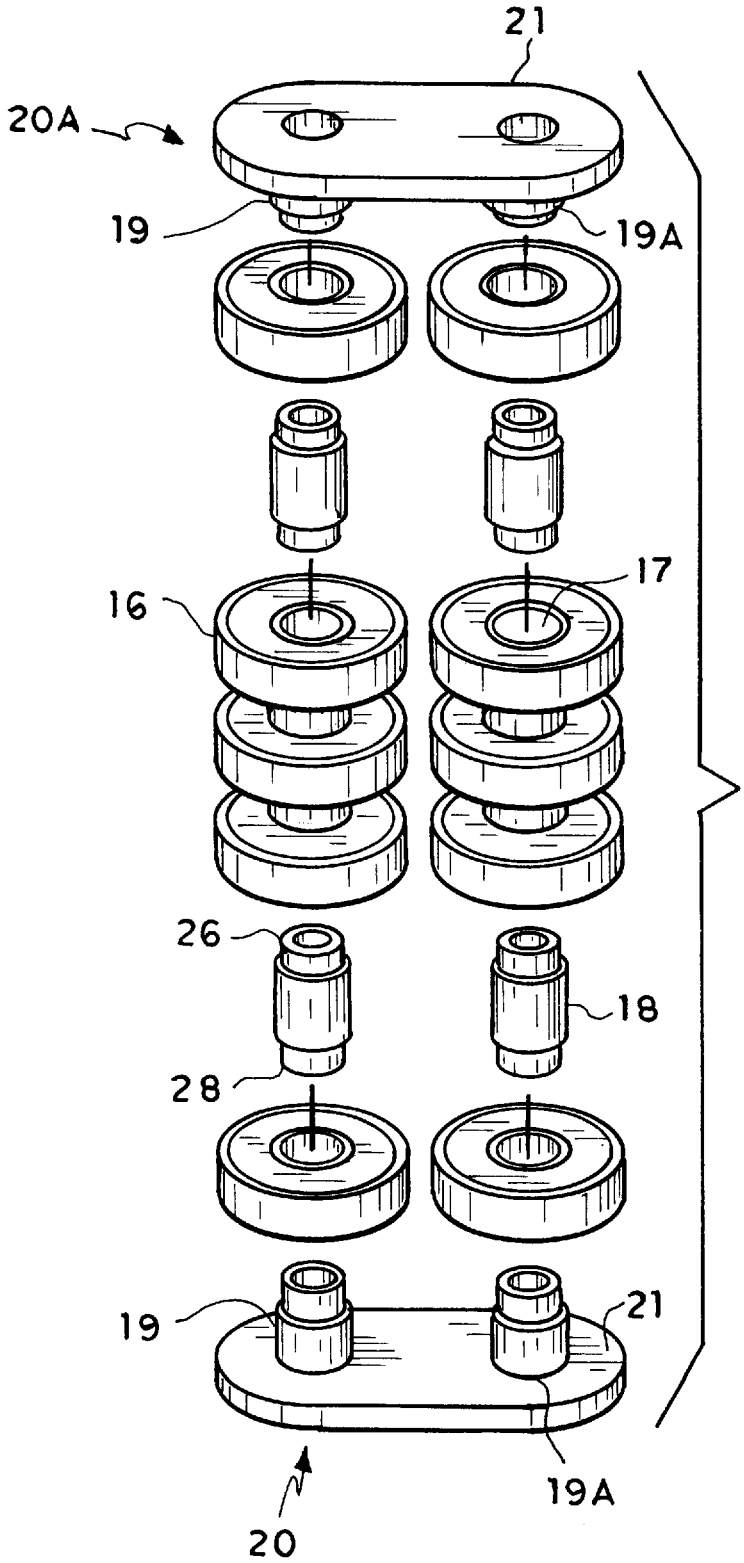
FIG. 2 is a partially exploded, perspective view of the components of the modular stacking unit of the present invention in a partially assembled state relative to roller blade wheel bearings.
Figure 3:
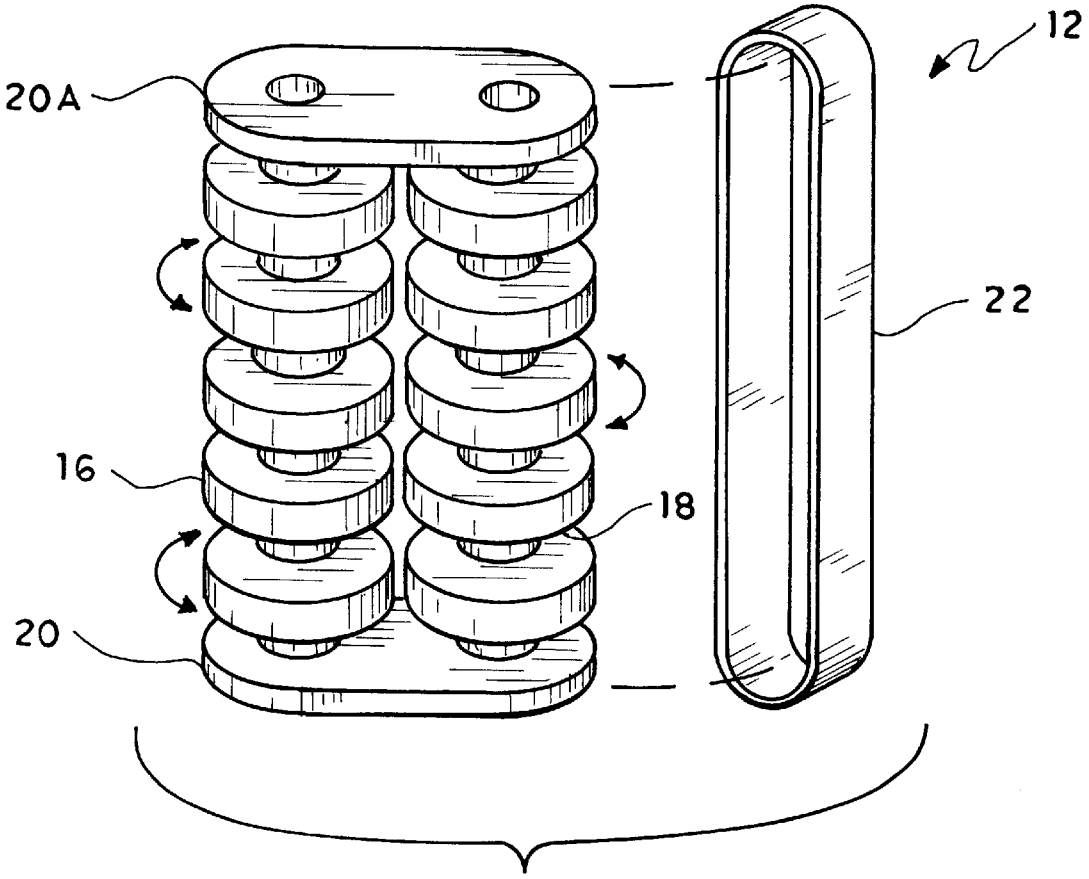
FIG. 3 is an partially exploded, perspective view illustrating the modular stacking unit in an assembled state.

The present invention is a method and a mechanism for cleaning roller blade wheel bearings, as illustrated in FIGS. 1, 2 and 3. In reference to FIG. 1., an apparatus or kit 8 for cleaning roller blade wheel bearings 16 is provided, including a container 10 and a modular stacking unit 12. The modular stacking unit 12, best shown in FIG. 3, comprises a first end cap 20, a second end cap 20*a*, a plurality of cylindrically shaped spacing elements 18 and a resilient band member 22. The modular stacking unit 12 is for use with but excludes preexisting wheel bearings 16, usually numbering ten or less in a pair of roller blades.

With respect to FIG. 2, the structure of the first end cap 20 and the second end cap 20*a* are clearly shown, with each end cap including a base for resting on a surface, preferably a flat portion 21, a first integral spacing element or integral spacer 19 which is preferably cylindrical in shape, and a second integral spacing element or integral spacer 19*a* which also preferably cylindrical in shape, each of the integral spacing elements 19, 19*a* being positioned proximal to the outer edge of the flat portion 21 and depending perpendicularly from the flat portion 21 of each of the planar end caps 20, 20*a*. Each of the integral spacing elements 19, 19*a* include an annular ledge-portion, which is slightly smaller in diameter than that of a roller blade wheel bearing central aperture 17 and disposed distal the flat portion 21. In an alternative embodiment, the diameter may be slightly enlarged in diameter over that of a roller blade wheel bearing central aperture 17 so that a press, friction fit may engage the walls of the central aperture and thereby hold the spacing element therein.

Similarly, each of the plurality of cylindrically shaped spacing elements 18 has an upper annular ledge-portion 26 and a lower annular ledge-portion 28, with both ledge-portions 26, 28 being slightly smaller in diameter than that of a roller blade wheel bearing central aperture 17. Again, in the alternative embodiment, the diameter may be slightly enlarged in diameter over that of a roller blade wheel bearing central aperture 17 so that a press, friction fit may engage the walls of the central aperture and thereby hold the spacing element therein.

The container 10 provided with the apparatus 8 comprises a cylindrical wall, a first end portion 14 and a second end portion 14*a*, which taken together define an interior volume. Forming a lid, the first end portion 14 allows selective access to the interior volume.

Assembly of the modular stacking unit 12 to the state shown in FIG. 3 is partially set forth in FIG. 2. Placing the flat portion 19 of the first planar end cap 20 on a horizontal surface, the annular ledge-portion of the integral spacer 19 faces upwardly in a horizontal plane. The central aperture 17 of a roller blade wheel bearing 17 is then inserted onto the ledge-portion, providing a seat upon which a roller blade wheel bearing is supported. The ledge-portion is dimensioned and configured to pass approximately half way into the central aperture 17 and should not exceed the length of the central aperture, thereby providing space for seating of a spacing element 18 on the opposing side of the wheel bearing 16.

The lower annular ledge-portion of the cylindrically shaped spacing element 18 is then inserted within the top side of the same roller blade wheel bearing central aperture 17. Thus, the upper ledge-portion of the cylindrically shaped spacing element 18 is now available for seating of a bottom portion of a central aperture 17 of another roller blade wheel bearing, and so on, by which a column of spacing elements 18 and wheel bearings 16 are built. The spacing element 18 thereby provides a gap between the two roller blade wheel bearings 16 and disposes the roller blade wheel bearings 16 in a horizontal and parallel relation to one another. This relationship provides both the integral spacing elements 19 19*a* and the cylindrically shaped spacing elements 18 with the advantage that the roller blade wheel bearings 16 are allowed to rotate in either direction around an axis defined by the column.

As suggested by FIG. 2, the previous step of inserting the upper ledge-portion 26 and the lower ledge-portion 28 within the central aperture of a roller blade wheel bearing 17 are repeated with three more cylindrically shaped spacing elements 18, resulting in a column of five equidistant and horizontally stacked roller blade wheel bearings. Following the same procedure used to assemble the aforementioned row, a second row is assembled beginning with the integral spacing element 19*a*.

Once two equally tall columns have been formed, the ledge-portion of the integral spacing elements 19, 19*a* of the second planar end cap 20*a* is inserted into the central apertures 17,17 of the uppermost roller blade wheel bearings 16,16 of the first and second columns, thereby capping the columns. The assembly sandwiches ten roller blade wheel bearings 16 equidistantly separated by eight cylindrically shaped spacing elements 18 and four integral spacing elements 19, 19*a*, and holds eight roller blade wheel bearings 16 in vertical relation to one another and to the first and second end caps 20, 20*a*. In the first embodiment, a resilient band member 22 may then be secured around the outer surface of the medial portion of the first planar end cap 20 and the second planar end cap 20*a*, compressing the modular stacking unit 12 and ensuring correct, maintained position of the roller blade wheel bearings 16 relative to one another. Rotational movement of the roller blade wheel bearings 16 in either direction around an axis parallel with an associated column is allowed after securing the resilient band member 22 to the outer surface of the first planar end cap 20 and the second planar end cap 20*a*.

Figure 4:
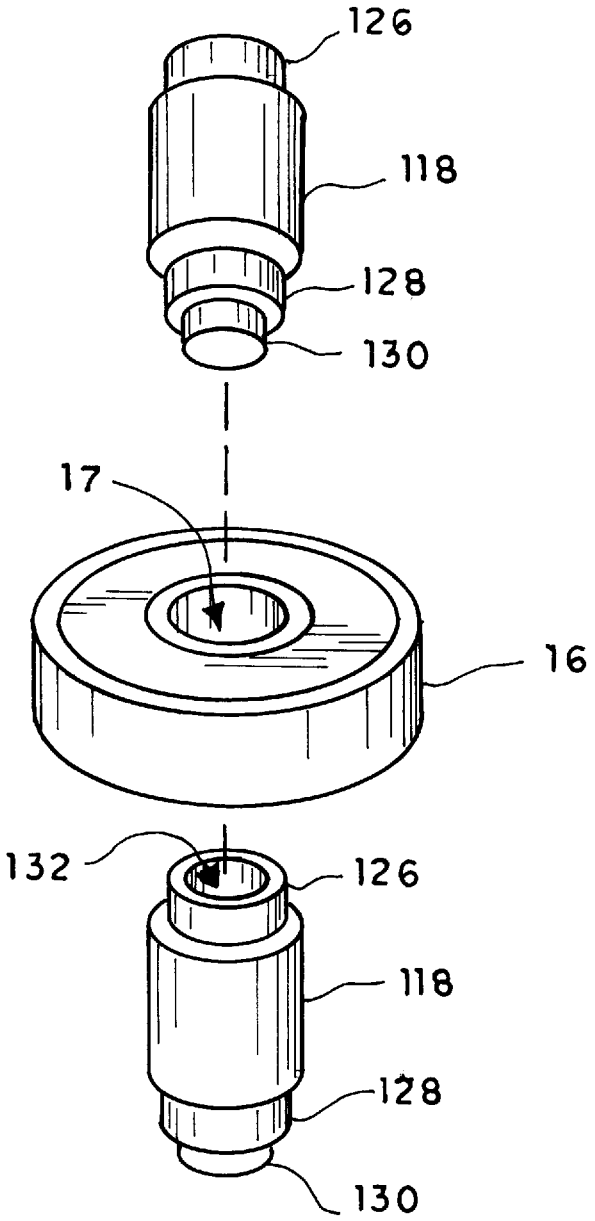
FIG. 4 is a second embodiment of the spacing elements.

However, in an alternative embodiment, each of the spacing elements may be further modified to comprise a body having opposing ends each with an annular ledge-portion with a means for joining two spacing elements axially, the ledge-portion also dimensioned to allow a portion of the body to pass into the central aperture of the roller blade bearing and thereby form an annular seat to rest the bearing upon. As can be understood from FIG. 4, an alternative embodiment can be envisioned in which the resilient band member 22 (and the need therefore) is eliminated, in which the ledge-portion 28 or 26 of the first embodiment is modified. Each of the plurality of cylindrically shaped spacing elements 118 has an upper annular ledge-portion 126 and a lower annular ledge-portion 128, with both ledge-portions 126, 128 being slightly smaller in diameter than that of a roller blade wheel bearing central aperture 17. However, one of the ledge portions is further adapted by joining means which permit a frictional or snap fit of a seat portion of a first spacing element axially into a cavity 132 defined by a neighboring spacing element. Such means 130 may include any of a number of structural devices, including a simple dowel, a stud integrally depending from one of the two ledge-portions, an annular lip, a plurality of prongs adapted to matingly engage an opposing plurality of apertures, or any other means joining the spacing elements into a uniform column and permitting rotation of the bearings thereon while fixed in a single plane. The embodiment shown is exemplary of a self-joining spacing element which permits a serial assembly of bearings and spacing elements and resulting column which permits the bearings to rotate freely on the spacer column.

Once the modular stacking unit 12 is in a fully assembled state, it is dimensioned to fit within the interior volume of a container 10, where it is placed along with a small quantity of solvent as shown in FIG. 1. Manual shaking or agitation of the capped container 10 circulates the solvent throughout the interior volume of the container, coating and cleaning the entire surface area of the roller blade wheel bearings 16. Most notably, with vigorous agitation the solvent is allowed to pass directly through the race of the bearing because each of the wheel races are highly exposed to the solvent path during agitation. This advantage occurs by virtue of the manner in which the spacers are placed in a recessed relationship from the circumferential edge of the wheel bearings, thereby being free from interference with the path of solvent.

After sufficient cleansing has been determined, the modular stacking unit 12 is removed from the interior volume of the container 10, and may be removed manually by its end cap with a minimum of contact with the solvent. The modular stacking unit 12 can be removed and the bearings 16 together rolled while positioned on the spacer column, in a back and forth motion, over an absorbent material so as to immediately and thoroughly dry them. Thus, the roller blade wheel bearings 16 rotate together in either direction around the columnar axis of the spacer column. This confers an advantage heretofore unknown, namely being able to clean, remove and dry all of the bearings collectively, thereby substantially reducing the time necessary to complete reinstallation of the bearings and simplifying the process so that persons of all ages enjoying roller blading can perform effective bearing service.

Upon reaching the desired dryness, the resilient band member 22 of the first embodiment is then removed from the modular stacking unit 12 and both the first and second planar end caps 20, 20*a*, whereupon the eight cylindrical spacing elements 18 are separated and detached from the roller blade wheel bearings 16.

As can easily be envisioned, changes may be made to the preferred embodiment and still embody the present invention. For example, the body of the cylindrical spacing elements 18 may be irregularly shaped, or tubular, or provided with any suitable shape which avoids interference with the race of the bearing, yet provides spacing of the bearings at a predetermined distance in a fixed plane. Likewise, the ledge-portion may be shaped as necessary to accommodate the central aperture of the wheel bearing, including square, triangular or other polygonal cross sections. Also, more or less than two integral spacers may be provided on the flat portion of the end caps. The elastic band may be substituted with a rigid clamp or the like. As previously noted, an alternative binding means, such as dowels which may be fitted to engage a bore axially passing through each ledge-portion of a cylindrical spacing element to frictionally engage another cylindrical spacing element, or an enlarged diameter of the ledge portion to cause a press fit, may be used thereby eliminating the need for an elastic band. Therefore, it is to be understood that the present invention is not limited to the embodiment described above, but encompasses any and all embodiments within the scope of the following claims.

I claim:

1. A cleaning apparatus for use with wheel bearings each having a central aperture and an externally exposable bearing race surrounding the central aperture, said apparatus comprising:

a first end cap having a base and at least one integral spacing element depending from said base, said integral spacing element having a ledge-portion for seating a wheel bearing thereupon by passing within the central aperture, said ledge-portion disposed on said spacing element opposite said base;

a second end cap having a base and at least one integral spacing element depending perpendicularly from said base, said integral spacing element having a ledge-portion for seating a wheel bearing thereupon by passing with said central aperture, said ledge-portion disposed on said spacing element opposite said base;

a plurality of spacing elements each having an upper ledge-portion and a lower ledge-portion, said upper ledge-portion and said lower ledge-portion each dimensioned and configured in diameter to receive the central aperture and remain free of interference with the race of the wheel bearing;

a binding means for temporarily binding together at least one column of at least one alternately engaged pair of a spacing element and a wheel bearing, the column being capped at each end by one of said first end cap and said second end cap;

whereby insertion of said upper ledge-portion and said lower ledge-portion within a roller blade wheel central aperture permits direct access of a fluid to a roller blade wheel bearing race and allows rotational movement between the spacing elements and a roller blade wheel bearing.

2. The cleaning apparatus according to claim 1, further comprising a container dimensioned and configured to receive the column and a predetermined volume of liquid solvent.

3. The cleaning apparatus according to claim 2 wherein said container comprises a continuous wall, a first end portion and a second end portion, wherein said continuous wall, said first end portion and said second end portion define an interior volume, said first end portion having an open mouth, and a cap for sealing said open mouth of said first end portion.

4. The cleaning apparatus according to claim 1 further including a solvent for dissolving wheel bearing lubricant.

5. The cleaning apparatus according to claim 4 wherein said solvent is organic, non-toxic, non-flammable and water soluble.

6. The cleaning apparatus according to claim 4 wherein said binding means is a band of resilient material, dimensioned and configured to tautly encircle said column.

7. The cleaning apparatus according to claim 1 wherein each of said plurality of spacing elements has a cylindrical body.

8. A method for cleaning wheel bearings comprising the steps of:

providing a plurality of wheel bearings, including a first wheel bearing and a second wheel bearing, each having a central aperture and an externally exposable bearing race surrounding the central aperture;

providing a plurality of spacing elements, including a first spacing element and a second spacing element, each having a ledge-portion for seating a wheel bearing by passing within a portion of the central aperture;

inserting a first spacing element within a portion of the central aperture of a first wheel bearing;

inserting a second spacing element within the remaining portion of the central aperture of the first wheel bearing;

inserting the second spacing element with the remaining portion of the central aperture of a second wheel bearing;

temporarily securing the assembly of spacing elements and wheel bearings together;

providing a container for receiving the assembly;

filling the container with a small quantity of solvent;

inserting the assembly within the container; and agitating the container.

9. The method for cleaning wheel bearings according to claim 8 further comprising the steps of:

removing the assembly from the container; and rolling the assembly along an absorbent material.

10. The method for cleaning wheel bearings according to claim 8 further comprising the steps of:

providing a pair of end caps having a base for resting on a flat surface; and securing each of said end caps to one end of the assembly.

11. A cleaning apparatus for use with wheel bearings each having a central aperture and an externally exposable bearing race surrounding the central aperture, said apparatus comprising:

a first capping means having a ledge-portion for seating a wheel bearing thereupon by passing within the central aperture;

a second capping means having a ledge-portion for seating a wheel bearing thereupon by passing with said central aperture;

at least one spacing means having opposing ends each for receiving a wheel bearing thereupon wherein each said opposing end is adapted to pass within the central aperture free of obstruction of the race of the bearing while providing spacing of the received bearings in a fixed plane and at a predetermined distance from one another; and, joining means for interchangeably engaging and joining one of said ledge-portions of said first capping means, said second capping means and said spacing means with one another, said joining means dimensioned and configured to remain disposed within said central aperture.

* * * * *